US006766862B2

(12) United States Patent
Chatterji et al.

(10) Patent No.: US 6,766,862 B2
(45) Date of Patent: Jul. 27, 2004

(54) EXPANDABLE SAND CONTROL DEVICE AND SPECIALIZED COMPLETION SYSTEM AND METHOD

(75) Inventors: Jiten Chatterji, Duncan, OK (US); R. Ashley Donaldson, Houston, TX (US); Ronald G. Dusterhoft, Katy, TX (US); Tommy Frank Grigsby, Houma, LA (US); Travis T. Hailey, Jr., Sugarland, TX (US); Jackie M. LaFontaine, Spring, TX (US); Philip D. Nguyen, Duncan, OK (US); John Podowski, Flower Mound, TX (US); Alex Procyk, Houston, TX (US); Sanjay Vitthal, New Orleans, LA (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/342,545

(22) Filed: Jan. 15, 2003

(65) Prior Publication Data

US 2003/0131997 A1 Jul. 17, 2003

Related U.S. Application Data

(62) Division of application No. 09/698,327, filed on Oct. 27, 2000, now Pat. No. 6,543,545.

(51) Int. Cl.[7] ..... E21B 43/08

(52) U.S. Cl. ..... 166/381; 166/207; 166/278; 166/285; 166/227

(58) Field of Search ..... 166/387, 185, 166/187, 207, 276, 278, 51, 383, 153, 227–230, 233, 285, 291, 295, 381

(56) References Cited

U.S. PATENT DOCUMENTS

| | | | |
|---|---|---|---|
| 1,514,062 | A | 11/1924 | McLain |
| 2,135,909 | A | 11/1938 | Monson |
| 2,187,895 | A | 1/1940 | Sanders |

(List continued on next page.)

FOREIGN PATENT DOCUMENTS

| | | |
|---|---|---|
| GB | 2 344 606 A | 6/2000 |
| WO | WO 96/37680 | 11/1996 |
| WO | WO 97/17527 | 5/1997 |
| WO | WO 98/49423 | 11/1998 |
| WO | WO 99/56000 | 11/1999 |
| WO | WO 00/26500 | 5/2000 |
| WO | WO 00/26501 | 5/2000 |
| WO | WO 00/26502 | 5/2000 |

*Primary Examiner*—Zakiya Walker
(74) *Attorney, Agent, or Firm*—Peter V. Schroeder

(57) ABSTRACT

In general, a method is provided for completing a subterranean wellbore, and an apparatus for using the method. The method comprises positioning an expandable sand-control device in the wellbore thereby forming an annulus between the sand-control device and the wellbore; depositing a filter media in the annulus; and after the depositing step, radially expanding the sand-control device to decrease the volume of the annulus. The sand-control device can be a sand screen or slotted or perforated liner having radially extending passageways in the walls thereof, the passageways designed to substantially prevent movement of the particulate material through the passageways and into the sand-control device. Where a slotted liner is desired, the passageways can be plugged during positioning and later unplugged for production. Another embodiment of the method and apparatus presented herein comprises positioning a well-completion device into the wellbore, thereby forming an annulus between the well-completion device and the wellbore, the well-completion device having a flexible, permeable membrane sleeve surrounding an expandable sand-control device; and thereafter radially expanding the sand-control device to decrease the volume of the annulus, thereby also expanding the membrane sleeve. The well-completion device can further include a layer of filter media encased between the membrane sleeve and the sand-control device. The filter media may be of any type known in the industry. Preferably, the membrane sleeve, when expanded, substantially fills the annular space extending between the wellbore and the sand-control device by deforming to substantially contour the wellbore.

26 Claims, 2 Drawing Sheets

U.S. PATENT DOCUMENTS

| | | | | |
|---|---|---|---|---|
| 2,190,989 | A | 2/1940 | Johnston | |
| 2,193,808 | A | 3/1940 | Dieterich | |
| 2,288,557 | A | 6/1942 | Vollmer | |
| 3,044,547 | A | 7/1962 | Jarboe | |
| 3,119,448 | A | 1/1964 | Rhoades | |
| 3,179,168 | A | 4/1965 | Vincent | |
| 3,203,483 | A | 8/1965 | Vincent | 166/207 |
| 3,270,817 | A | 9/1966 | Papaila | |
| 3,353,599 | A | 11/1967 | Swift | |
| 3,368,623 | A | 2/1968 | Carter | |
| 3,477,506 | A | 11/1969 | Malone | 166/207 |
| 3,498,376 | A | 3/1970 | Sizer et al. | 166/120 |
| 3,605,899 | A | 9/1971 | Tate | |
| 3,669,190 | A | 6/1972 | Sizer et al. | |
| 3,746,091 | A | 7/1973 | Owen et al. | 166/207 |
| 3,776,307 | A | 12/1973 | Young | 166/125 |
| 3,816,151 | A | 6/1974 | Podias | |
| 3,862,663 | A | 1/1975 | Curtice | |
| 4,095,825 | A | 6/1978 | Butler | 285/55 |
| 4,687,232 | A | 8/1987 | Zimmerman | 285/31 |
| 5,014,779 | A | 5/1991 | Meling et al. | 166/55.7 |
| 5,062,484 | A | 11/1991 | Schroeder | |
| 5,339,902 | A | 8/1994 | Harris | |
| 5,363,916 | A | 11/1994 | Himes | |
| 5,529,123 | A | 6/1996 | Carpenter | |
| 5,667,011 | A | 9/1997 | Gill et al. | 166/295 |
| 5,850,875 | A | 12/1998 | McCulloch | 166/380 |
| 5,931,232 | A | 8/1999 | Echols | 166/378 |
| 5,984,568 | A | 11/1999 | Lohbeck | 403/375 |
| 6,012,523 | A | 1/2000 | Campbell et al. | 166/277 |
| 6,021,850 | A | 2/2000 | Wood et al. | 166/380 |
| 6,029,748 | A | 2/2000 | Forsyth et al. | 166/380 |
| 6,063,738 | A | 5/2000 | Chatterji | |
| 6,070,671 | A | 6/2000 | Cumming et al. | 166/381 |
| 6,263,966 | B1 * | 7/2001 | Haut et al. | 166/278 |

* cited by examiner

EXPANDABLE SAND CONTROL DEVICE AND SPECIALIZED COMPLETION SYSTEM AND METHOD

CROSS REFERENCE TO RELATED APPLICATION

This application is a divisional of commonly owned application Ser. No. 09/698,322 filed Oct. 27, 2000 now U.S. Pat. No. 6,543,545, entitled "Expandable Sand-control device and Specialized Completion System and Method," the disclosure of which is incorporated herein by reference in its entirety.

FIELD OF INVENTION

The present invention relates to sand-control apparatus and methods in a subterranean hydrocarbon well. More particularly, the present invention relates to methods and apparatus for using an expandable sand control device in conjunction with a specialized gravel pack fluid system.

BACKGROUND

The control of the movement of sand and gravel into a wellbore and production string has been the subject of much importance in the oil production industry. Gravel pack operations are typically performed in subterranean wells to prevent fine particles of sand or other debris from being produced along with valuable fluids extracted from a geological formation. If produced, the fine sand tends to erode production equipment, clog filters, and present disposal problems. It is therefore economically and environmentally advantageous to ensure that the fine sand is not produced. During gravel packing, the annulus between the well bore wall and the production tubing, which can include a screen or slotted liner assembly, is filled with selected natural or man-made packing material, or "gravel." Such packing materials can include naturally occurring or man-made materials such as sand, gravel, glass, metal or ceramic beads, sintered bauxite and other packing materials known in the art. The gravel prevents the fine sand from the formation from packing off around the production tubing and screen, and the screen prevents the large grain sand from entering the production tubing.

One difficulty in packing operations, especially in open-hole wellbores, is completely filling the often irregular annular space between the production tubing and the wellbore wall. Where packing is incomplete, "voids" are left around the production tubing. These voids, or areas which are incompletely packed with gravel, allow sand fines to be produced along the area of sand screen or slotted liner. The fines can clog the production assembly or erode production equipment.

Consequently, a more effective method of packing a wellbore is needed.

SUMMARY

In general, a method is provided for completing a subterranean wellbore, and an apparatus for using the method. The method comprises positioning an expandable sand-control device in the wellbore thereby forming an annulus between the sand-control device and the wellbore; depositing a filter media in the annulus; and after the depositing step, radially expanding the sand-control device to decrease the volume of the annulus. The sand-control device can be a sand screen or slotted or perforated liner having radially extending passageways in the walls thereof, the passageways designed to substantially prevent movement of the particulate material through the passageways and into the sand-control device. Where a slotted liner is desired, the passageways can be plugged during positioning and later unplugged for production.

The filter media is typically a particulate material and can be deposited as a slurry comprising liquid material and particulate material, or as a cement slurry. The step of expanding the sand-control device further includes squeezing at least a portion of the liquid of the slurry through the sand-control device passageways thereby forming a pack in the wellbore annulus. The liquid material can be water-based, oil-based or emulsified and can include gelling agents. Further, the particulate can be resin coated with a delayed form system. The form system can include particulate material. The foam can also include decomposable material which can be decomposed after placement of the form in the annulus.

Another embodiment of the method and apparatus presented herein comprises positioning a well-completion device into the wellbore, thereby forming an annulus between the well-completion device and the wellbore, the well-completion device having a flexible, permeable membrane sleeve surrounding an expandable sand-control device; and thereafter radially expanding the sand-control device to decrease the volume of the annulus, thereby also expanding the membrane sleeve. The well-completion device can further include a layer of filter media encased between the membrane sleeve and the sand-control device. The filter media may be of any type known in the industry. Preferably, the membrane sleeve, when expanded, substantially fills the annular space extending between the wellbore and the sand-control device by deforming to substantially contour the wellbore.

BRIEF DESCRIPTION OF THE DRAWINGS

Drawings of the preferred embodiment of the invention are attached hereto, so that the invention may be better and more fully understood, in which.

Figure 1:
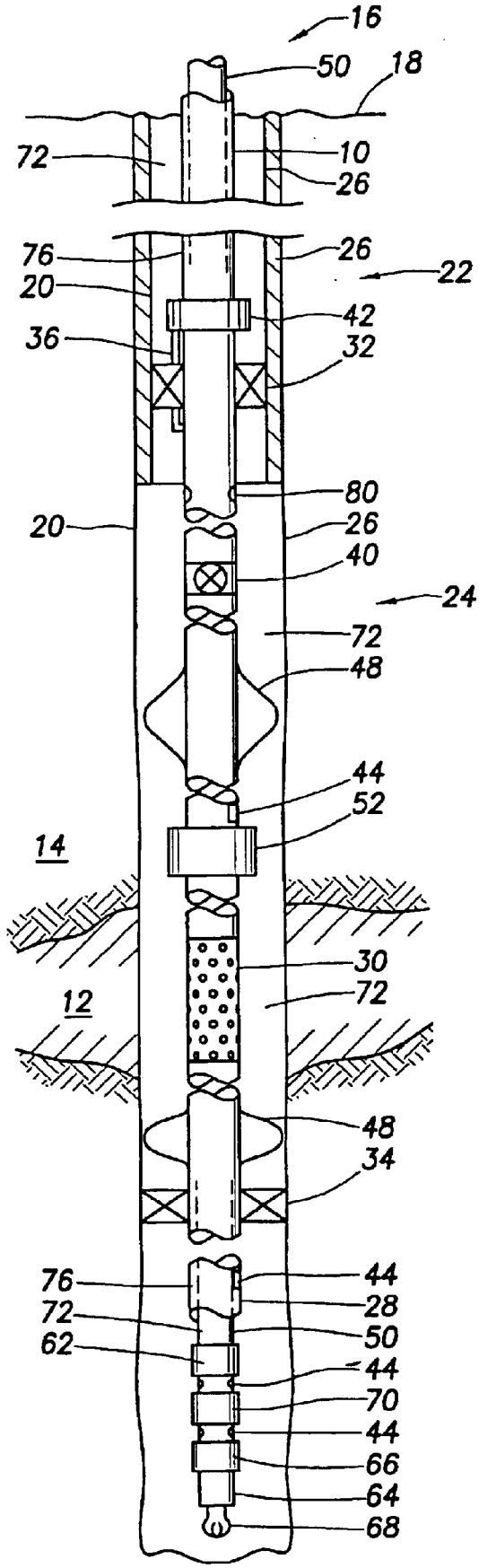
FIG. 1 is a schematic elevational cross-sectional view of a typical subterranean well and tool string utilizing the invention.

Numeral references are employed to designate like parts throughout the various figures of the drawing. Terms such as "left," "right," "clockwise," "counterclockwise," "horizontal," "vertical," "up" and "down" when used in reference to the drawings, generally refer to orientation of the parts in the illustrated embodiment and not necessarily during use. The terms used herein are meant only to refer to the relative positions and/or orientations, for convenience, and are not meant to be understood to be in any manner otherwise limiting. Further, dimensions specified herein are intended to provide examples and should not be considered limiting.

DETAILED DESCRIPTION OF THE PREFERRED EMBODIMENT

Referring now to FIG. 1, a tubing string 10 is shown run in well 16 at least to the zone of interest 12 of the formation 14. The well 16 can be on-shore or offshore, vertical or horizontal, consolidated or unconsolidated and can be cased or an open-hole. It is expected that the invention will be primarily utilized in open-hole horizontal wells, but it is not limited to such use. The tubing string 10 extends from the well surface 18 into the well bore 20. The well bore 20 extends from the surface 18 into the subterranean formation 14. The well bore 20, having well bore wall 26, extends through a cased portion 22 and into an un-cased open-hole portion 24 which includes the zone of interest 12 which is to be produced.

In the cased portion 22 of the well, the well bore 20 is supported by a casing 26. The well bore typically is cased, as shown, continuously from the well surface but can also be intermittently cased as circumstances require, including casing portions of the wellbore downhole from the zone of interest 12. The well is illustrated for convenience as vertical, but as explained above, it is anticipated that the invention may be utilized in a horizontal well.

The tubing string 10 extends longitudinally into the well bore 20 and through the cased portion 22. The tubing string can carry packers, tester, circulating and multi-position valves, cross-over assemblies, centralizers and the like to control the flow of fluids through the tubing string and placement of the string in the well bore.

Adjacent the lower end 28 of the tubing string 10 a sand control device 30 is connected. The sand control device 30 can be of many types which are generally known in the art, including one or more sand screens. Preferably POROPLUS (a trademark) sand screens are used and reusable, retrievable screens are preferred. Apparatus and methods for constructing and deploying screens are used in conjunction with the invention. Exemplary sand-control screens and methods of deployment are disclosed in U.S. Pat. Nos. 5,931,232 and 5,850,875, and in U.S. Patent Application Ser. No. 09/627,196 filed Jul. 27, 2000, all of which are assigned to the assignee of this application and are incorporated herein by reference for all purposes.

Figure 3:
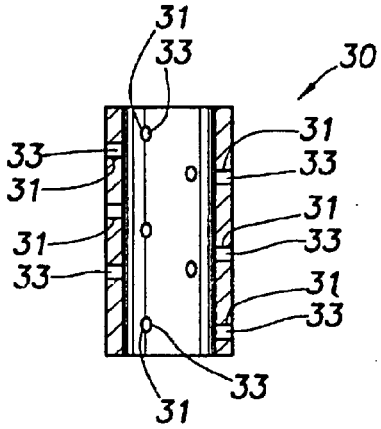
FIG. 3 is a detail of a slotted or perforated liner which can be used with the invention.
Figure 4A:
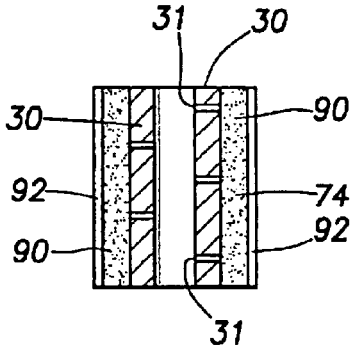
FIGS. 4A and 4B are views of alternate embodiments of the invention.
Figure 4B:
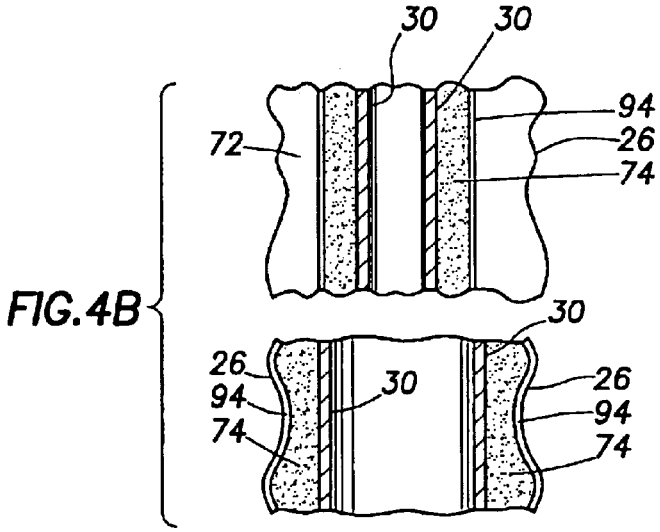

The sand control device 30 can also be a slotted or perforated liner or sleeve, such as seen in FIG. 3, and such as are known in the art, having radially extending passageways 31 to fluidly connect the interior of the slotted liner 30 with the formation. In the case of a slotted or perforated liner it may be desirable to plug the passageways 31 in the liner with plugs 33 during run-in of the tools and completion of the packing procedure. The passageways 31 can later be unplugged, or the plugs 33 removed, to allow fluid flow into the tubing string. Removal of the plugs 33 can be accomplished mechanically or chemically as is known in the art.

Mounted on the tubing string 10 are a hanger 32 and an open-hole packer 34. The packers are shown in their expanded or "set" positions. The packers are run into the hole in a retracted or unexpanded condition. The hanger 32 engages the casing 26 of the cased portion 22 of the well and typically provides a seal through which fluids and particulate cannot pass. The hanger 32 can be a retrievable direct hydraulic hanger with a control line access feature 36. The hanger can be of any type generally known in the art and can be an inflatable, compression or other type of hanger, and can be actuated hydraulically, by wireline or otherwise as will be evident to those of ordinary skill in the art. Similarly, the open-hole packer 34 may be of any type known in the art such as a "hook wall" packer or a non-rotating inflatable packer. The packer can be retrievable if desired. Additional or fewer packers and hangers can be employed without departing from the spirit of the invention. A lower packer 34 may only be necessary when it is desired to seal off a non-producing zone downhole from the zone of interest 12.

The tubing string 10, as shown in FIG. 1, can additionally carry other drill string tools for controlling and measuring fluid flow and well characteristics and for manipulating the tubing string. Illustrated are a valve 40, a cross-over kit 42 having a control line 36, and disconnects 44. These tools are generally known in the art and additional tools, such as collars, measuring devices, and samplers can be added to the tool string as desired.

Figure 2:
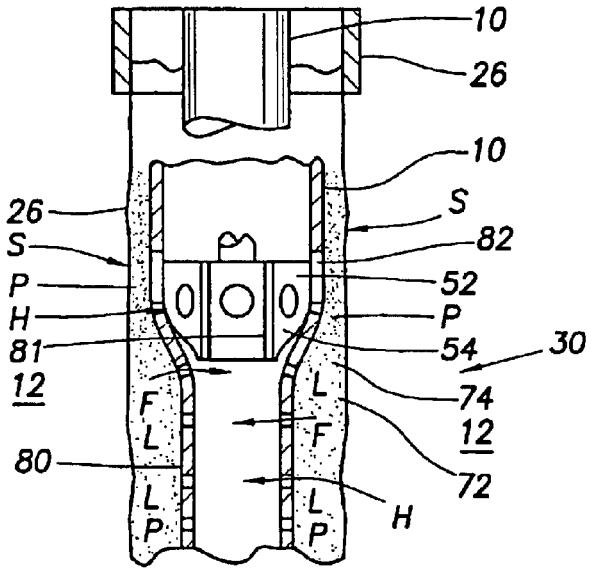
FIG. 2 is a schematic elevational detail, in cross-section, of the depositing the filter media and expanding the expandable sand-control device of the invention.

The tubing string 10 or work string 50 also carries an expansion tool assembly 52. The expansion tool assembly is run into the well in a retracted position so as not to interfere with movement of the tubing and work strings, as seen in FIG. 1. The expansion tool is activated to an expanded position 54, as seen in FIG. 2, and drawn through the expandable sand-control device 30. The expansion cone, or other expansion device, such as is known in the art, can be hydraulically actuated by a downhole force generator or can be forced along the tubing string by weight applied to the work string. The expansion of the expandable sand-control device can occur from top-down or from bottom-up, as desired. Preferably the expansion tool assembly is retrievable.

The tubing string preferably carries centralizers 48 which act to maintain the tubing string in a spaced relation with the well bore wall 26. This is of particular importance where the well bore is horizontal. The details of construction of the centralizers 48 varies according to the requirements of the application and include segmented "fin" devices, round disks as well as the centralizers shown. The centralizers aid in cuttings removal and protect the expandable sand-control device 30 during run-in and drilling operations, as well.

A working string 50 can be deployed interior of the tubing string 10 and sand-control device 30. Working string 50 can carry a plurality of well tools as are known in the art. Such tools can include a measuring while drilling assembly 62, a shoe 64, a downhole motor 66, a drill bit 68 and a receptacle 70 for the downhole motor and bit, as shown. Preferably these tools are retrievable. Additional tools and types of tools can be utilized as well without departing from the spirit of the invention. Those skilled in the art will recognize a vast choice of tool combinations depending on the requirements of the formation and desires of the practitioner.

The measuring while drilling assembly 62 preferably includes a logging while drilling function and may include an acoustic telemetry system to provide real-time data acquisition of well characteristics. Other data acquisition instruments can also be employed.

Disconnects 44 allow sections of the tubing and work strings to be released for retrieval to the surface for reuse. Additionally the disconnects can allow portions of the strings, such as downhole motor 66 and drill bit assembly 68 to be retracted into receptacle 70 used for that purpose. Disconnects 44 are of types generally known in the art and may be mechanically, hydraulically or explosively actuated.

A tool assembly, such as the one shown in FIGS. 1 and 2, is drilled into place in formation 14 using a downhole motor 66 and drill bit 68 assembly. The tool assembly can include a downhole motor 66 with bit 68, a measuring while drilling tool assembly 62, a receptacle housing 70, an expanding screen or slotted liner device 30, blank tubing 72 and an expansion tool assembly 52. Depending on the tool assembly configuration, the expansion tool 52 can be run-in as part of the assembly or on a separate trip. Also depending on the configuration, an inner tubing string, or work string 50 or the tubing string 10 with expandable sand-control device 30 can be used as the fluid conduit during drilling, wellbore fluid and filter media placement.

The bottom hole assembly is made up and run in the wellbore 20. The open-hole portion 24 will be drilled with the downhole motor 66 and drill bit 68 assembly along the desired well bore trajectory and to the desired depth. Once the zone of interest 12 is passed or reached, the wellbore can be cleaned to remove cuttings, as is known in the art. Once cleaned, a wellbore fluid can be placed in the well bore annulus 72 between the tubing string 10 and the well bore wall 26. The use of well bore fluids is well known in the art. Preferably the hanger 32 is set in the cased portion 22 of the well, as shown. Alternately, a packer may be used. The hanger anchors the sand-control device 30 in place.

The work string 50 can be released at disconnect 44 to allow recovery of the measurement while drilling tool 62 and latching of the downhole motor 66 and drill bit 68 assembly into the receptacle housing 70. The receptacle housing 70 seals the motor 66 from the sand-control device 30 if desired. The recovery of the work string may occur before or after insertion of the filter media 74 into the annulus 72 depending on the system configuration.

The filter media 74 is placed across the annulus 72, particularly along the length of the annulus surrounding the sand-control device 30. The filter media 72 can be inserted into the annulus 72 by any method known in the art, such as pumping the filter media 74 from the surface 18 through the annulus 76 between the work string 50 and the tubing string 10 and thereafter through ports 80 into annulus 72. The ports may be located at various places along the tubing string. Alternately, the filter media can be pumped out of the shoe 64 at the lower end of the hole. In such a case, the lower isolation packer 34 would be unnecessary. In cases where the tubing string 10 is run in on a separate trip from the drilling string 30, the filter media 74 can be pumped into the annulus 72 during running of the tubing string 10 or after the desired depth is reached by the string. Further, the filter media 74 can be pumped in as the welbore fluid is removed. The method and direction of pumping, or inserting, the filter media 74 is not critical to the invention. Various methods of placing the filter media 74 into the annulus 72 will be readily apparent to those of skill in the art. Preferably, the drilling operation, filter pumping operation and sand-control device expansion operation can be accomplished with a single trip of the combined tubing string and concentric work string. However, multiple trips may be necessary or desired depending on the configuration employed.

The filter media 74 of the process can take several forms. Some of the fluids covered by the invention are a suspension of particulates in fluid, a particulate slurry and foamed systems.

The filter media 74 can be a suspension of particulates in fluid. The particulates in this application could be of any size appropriate for controlling sand production from the reservoir. In addition, the proppant, or particulate, specific gravity preferably ranges from 1.1 to 2.8. The specific gravity and other characteristics of the particulate will vary, however, and are determined by the required downhole hydrostatic pressure. The use of lightweight particulate is preferable where the major mechanism for inducing a squeezing of the 'void filling fluid', or filter media, is caused by expansion of the sand-control device. Particulate, or proppant, loading preferably ranges between 0.1 to 20 ppg, but is not limited to this range. The carrier fluid for the particulate can be water-based, hydrocarbon-based, or an emulsified system. Examples of water based system include, but are not limited to, clear brines or those that include the use of gelling agents such as HEC, xanthan, viscous surfactant gel or synthetic polymers. In addition, the water-based system bay be weighted by the addition of salts such as calcium chloride or other conventional brines as used in the oil field. Examples of hydrocarbon based systems include, but are not limited to, the use of gelled oils and drill-in fluids. Emulsified systems (water external or oil external) can also be used.

Another filter media system 74 can be applied is a solid particulate/cement slurry mixture that after liquid removal by the squeezing action of the expansion of the sand-control device, and after the passage of time, creates a porous media through which hydrocarbons and other fluids can be produced while controlling fines migration. Particulate concentrations can range from 5 to 22 ppg, but will vary based on application conditions. The density of the particulates can range from 1.1 to 2.8, but may also vary. Testing with such a system containing 20/40 sized sand indicated that a permeability of 40 Darcy and an unconfined compressive strength of 900 psi could be developed with this system. Such a system, with these permeability and strength factors, is desirable in most well formations.

A system in which a particulate coated with a resin material is also covered by this invention. The resin material may be activated by well temperature, time, stress induced by liquid removal, or through the use of an activator that is injected after the liquid removal process. Resins and activators are well known in the art.

The filter media can be a foamed system, with or without particulates, that creates an open-faced permeable foam after liquid removal. A chemical treatment, after dehydration, may be necessary to enhance the permeability of the foam. A typical system for this application could be a foamed cement to which a mixture of crosslinked-gel particulate and carbonate particles of appropriate size have been added to the slurry. The crosslinked gel particles have a chemical breaker added to them. After liquid removal the crosslinked gel particles are broken by the in-situ breaker leading to the creation of a porous media. The permeability of the porous media can be further enhanced by pumping an acid to dissolve the crosslinked gel and the calcium carbonate particles. This invention also covers the use of alternative materials that can decompose by contact with conventional brines or oil soluble systems such as oil soluble resin or gilsonite that can be dissolved by contact with hydrocarbons. Degradable semi-solid gel particulate material can also be used in the filter system to act as a means to increase the porosity of the filter media after the carrier fluid is removed by squeezing. This will enhance the permeability and prevent excessive losses in permeability caused by the dehydration process. Various types of foam and particulate mixtures, and methods for improving permeability and porosity, will be recognized by those of skill in the art.

Surface modifying agents can be added to the solid material in the filtration media. These surface modifying agents can improve the filtration properties of the particulate material by stopping fines migration at the open hole, filter interface and prevent plugging of the filter media itself. Surface modifying agents can also be added to the particulate material in the filtration media to provide cohesive bonds between particles when the suspending fluid is at least partially removed by the squeezing effect of the sand-control device expansion. The cohesive strength in the pack will prevent movement of particles in the pack during production operations which will reduce any chance for well tool erosion.

Alternately, the permeable filter media is placed external of the sand-control device 30 prior to running and expanding in the subterranean wellbore. An open-cell, permeable, expandable, foamed material is molded or cast into a cylinder shape 90, sleeve or jacket. This foamed sleeve 90 is then slid over the expandable sand-control device 30 to encapsulate its outer wall before its downhole placement. The wall thickness of the sleeve is preferably from ¼ inch to 1 inch, depending on the diameters of the screen and wellbore. The permeable sleeve 90 can be tightly fit or glued to the device surface to prevent it from sliding off of the device during operation. The outer surface of the foamed sleeve 90 can be coated with high tensile strength "film" 92 or material to protect the sleeve from tearing or ripping during handling and installation of the expandable screen downhole.

The deformability of the foam allows it to fill up the void space or gaps between the screen and the formation as the screen is expanded against the open-hole wall 26. The foamed sleeve 90 can also be impregnated with synthetic beads, sands or proppant, to maintain permeability of the porous medium under compression.

The foamed sleeve 90 can also be impregnated with treatment chemical that can be slowly released, such as a breaker that can break up or dissolve the filter cake remaining after drilling operation. The treatment chemical can be mud breakers, such as oxidizers, enzymes or hydrolysable esters that are capable of producing a pH change in the fluid, scale inhibitors, biocides, corrosion inhibitors, and paraffin inhibitors that can be slowly released during production.

Another concept includes the use of a flexible, expandable, and permeable membrane 94, which is prepared in the shape of a sleeve or jacket to provide similar function as described in the above concept. The permeable sleeve, which can be pulled over the expandable screen covering its outer wall, acts as pouch containing the filter medium 74 (i.e. lightweight beads, sands, proppant, etc.). As the screen is expanded, the filter medium in the deformable membrane fills up the annulus space 72. This permeable membrane can be prepared from materials such as metals, polymers, or composites, so that it can tolerate both physical and chemical requirements of downhole conditions.

After placement of the filter media 74 in the wellbore annulus 72, the sand-control device 30 is expanded. As shown in FIG. 2, wherein the work string 50 has already been retrieved, the sand-control device 30 can be expanded from bottom-up. The expansion can occur top-down as well depending on the well tool configuration.

The sand-control device 30 is adjacent the zone of interest 12. The retractable expansion tool 52 is activated to its expanded position, as seen in FIG. 2, to expand the sand-control device. The sand-control device 30 is radially expanded from its unexpanded, or initial position or radial size 80, to its expanded position 82. During expansion, liquid L from the filter media 74 flows along lines F into the sand-control device 30 and then into the tubing string 10. If the expansion assembly is operated from the top-down, it may be desirable for the expansion assembly to have a bypass port 81 through which the fluid F may travel up into the tubing string 10. As at least a portion of the fluid F is squeezed from the filter media 74, the particulate material P is tightly packed into the annulus 72. The filter media particulate P cannot flow into the sand-control device 30. The screen or slotted holes of the sand-control device 30 are selectively sized and shaped to prevent migration of the particulate P into the device 30. The filter media particulate P remaining in the annulus 72 acts as a filter during production of hydrocarbons H from the well formation 14. Fines, or small sand particles S, are trapped or filtered by the remaining media and prevented from flowing into the sand-control device 30.

The filter media is pumped into the annulus 72 to fill up the annular space. However, conventional methods of packing often leave undesirable voids, or areas which are not filled with packing media. Preferably, in the current invention, as the filter media is squeezed between the wellbore wall 26 and the tubing string 10 during expansion of the sand-control device 30, any voids not previously filled are eliminated and filled-in with the filter media.

The filter media can prevent fines from migrating to the sand-control device, thereby preventing clogging and erosion of the well tools and sand-control device, and can prevent the formation from collapsing thereby reducing the production of fines. The tight packing of the media against the wellbore wall can also prevent shale spalling. Shale spalling could result in plugging of the media and sand-control device.

Preferably, when the filter media 74 is pumped into the annulus 72, the filter media fills the annulus at least a set distance into the cased portion 22 of the well as shown.

It will be seen therefore, that the apparatus and method addressed herein are well-adapted for use in flow testing an unconsolidated well formation. After careful consideration of the specific and exemplary embodiments of the present invention described herein, a person of skill in the art will appreciate that certain modifications, substitutions and other changes may be made without substantially deviating from the principles of the present invention. The detailed description is illustrative, the spirit and scope of the invention being limited only by the appended claims.

Having described the invention, what is claimed is:

1. A method of completing a wellbore in a subterranean formation, comprising the steps of:

a. positioning an expandable sand-control device in the wellbore and forming an annulus between the sand-control device and the wellbore, the sand-control device having passageways in the wall thereof, the passageways designed to substantially prevent movement of particulate material through and into the sand-control device, the passageways plugged to substantially prevent movement of liquid therethrough, through the passageways prior to the step of expanding of the sand-control device;

b. depositing a particulate material in the annulus, wherein the particulate material is deposited as a slurry comprising liquid material and particulate material;

c. after the depositing step, unplugging the passageways of the sand-control device; and d. after the depositing step, radially expanding the sand-control device to decrease the volume of the annulus, thereby squeezing at least a portion of the liquid of the slurry through the sand-control device passageways.

2. A method of completing a wellbore in a subterranean formation, comprising the steps of:

a. positioning an expandable sand-control device in the wellbore and forming an annulus between the sand-control device and the wellbore;

b. depositing a cement slurry in the annulus; and c. after the depositing step, radially expanding the sand-control device to decrease the volume of the annulus.

3. A method as in claim 2, further comprising the step of, after the expanding step, forming a substantially solid porous cement media, the media allowing hydrocarbon fluids to flow therethrough, the media substantially preventing sand from flowing therethrough.

4. A method of completing a wellbore in a subterranean formation, comprising the steps of:

a. positioning an expandable sand-control device in the wellbore and forming an annulus between the sand-control device and the wellbore;

b. depositing a particulate material in the annulus, a substantial amount of the material substantially coated with a resin;

c. after the depositing step, radially expanding the sand-control device to decrease the volume of the annulus.

5. A method as in claim 4, comprising the step of, after the step of expanding, activating the resin.

6. A method of completing a wellbore in a subterranean formation, comprising the steps of:

a. positioning an expandable sand-control device in the wellbore and forming an annulus between the sand-control device and the wellbore;

b. depositing a foam system in the annulus; and c. after the depositing step, radially expanding the sand-control device to decrease the volume of the annulus.

7. A method as in claim 6, wherein the foam system includes particulate material.

8. A method as in claim 6, the foam system includes decomposable materials.

9. A method as in claim 8, further comprising the step of, after the expanding step, decomposing the decomposable materials to form a foam permeable to fluids but which substantially prevents permeation by sand particles from the formation.

10. A method of completing a wellbore in a subterranean formation, comprising the steps of:

a. positioning an expandable sand-control device in the wellbore and forming an annulus between the sand-control device and the wellbore, wherein the expandable sand-control device is a member of a tool string assembly, the tool string assembly further comprising blank tubing a retrievable downhole drill motor and a retrievable measuring while drilling assembly;

b. depositing a filter media in the annulus; and c. after the depositing step, radially expanding the sand-control device to decrease the volume of the annulus.

11. A method of completing a wellbore in a subterranean formation, comprising the steps of:

a. positioning an expandable sand-control device in the wellbore and forming an annulus between the sand-control device and the wellbore, wherein the expandable sand-control device is supported from a hanger;

b. depositing a filter media in the annulus; and c. after the depositing step, radially expanding the sand-control device to decrease the volume of the annulus.

12. A method as in claim 11, wherein a portion of the wellbore has a casing and wherein the hanger is supported from the casing.

13. A method as in claim 11, further comprising setting a packer downhole from the expandable sand-control device.

14. A method of completing a wellbore in a subterranean formation, comprising the steps of:

a. positioning an expandable sand-control device in the wellbore and forming an annulus between the sand-control device and the wellbore;

b. depositing a filter media in the annulus;

c. after the depositing step, radially expanding the sand-control device to decrease the volume of the annulus; and d. running an inner-tubing string into the wellbore, the inner-tubing string positioned through an annular space in the sand-control device.

15. A subterranean well comprising:

a wellbore;

a tubing string comprising a retrievable downhole motor, the tubing string in the wellbore forming an annulus between the wellbore and the tubing string, the tubing string having an expandable sand-control device radially expandable from a retracted position to an expanded position, the tubing string having an expansion tool for expanding the sand-control device from the retracted to the expanded position, the sand-control device in the expanded condition; and a packing means for transmitting a filter media from the surface of the well to the annulus prior to expanding the expandable sand-control device.

16. A well as in claim 15, wherein the tubing string comprises a retrievable measuring-while-drilling apparatus.

17. A subterranean well comprising:

a wellbore;

a tubing string in the wellbore, forming an annulus between the wellbore and the tubing string, the tubing string having an expandable sand-control device radially expandable from a retracted position to an expanded position, the tubing string comprising a hanger for supporting the expandable sand-control device, and the tubing string having an expansion tool for expanding the sand-control device from the retracted to the expanded position, the expandable sand-control device in the expanded position; and a packing means for transmitting a filter media from the surface of the well to the annulus prior to expanding the expandable sand-control device.

18. A method well as in claim 17, wherein the tubing string comprises a packer downhole from the expandable sand-control device.

19. A method well as in claim 17, wherein a portion of the wellbore has a casing and wherein the hanger is set against the casing.

20. A subterranean well comprising:

a wellbore;

a tubing sting in the wellbore, forming an annulus between the wellbore and the tubing string, the tubing string having an expandable sand-control device radially expandable from a retracted position to an expanded position, the tubing string having an expansion tool for expanding the sand-control device from the retracted to the expanded position, wherein the expandable sand-control device is in the expanded position;

a packing means for transmitting a filter media from the surface of the well to the annulus prior to expanding the expandable sand-control device; and a foam system substantially filling the portion of annulus between the expanded sand-control device and the wellbore.

21. A subterranean well comprising:

a wellbore;

a tubing string in the wellbore, forming an annulus between the wellbore and the tubing string, the tubing string having an expandable sand-control device radially expandable from a retracted position to an expanded position, the tubing string having an expansion tool for expanding the sand-control device from the retracted to the expanded position, wherein the expandable sand-control device is in the expanded position;

a packing means for transmitting a filter media from the surface of the well to the annulus prior to expanding the expandable sand-control device; and a cement slurry substantially filling the portion of annulus between the expanded sand-control device and the wellbore.

22. A method of completing a well in a subterranean formation, the well having a wellbore, the method comprising the steps of:

a. positioning a well-completion device into the wellbore thereby forming an annulus between the well-completion device and the wellbore, the well-completion device having a flexible, permeable membrane sleeve surrounding an expandable sand-control device; and b. thereafter radially expanding the sand-control device to decrease the volume of the annulus, thereby also expanding the membrane sleeve.

23. A method as in claim 22, the well-completion device further comprising a layer of filter media encased between the membrane sleeve and the sand-control device.

24. A method as in claim as in 23, wherein the filter media is gravel.

25. A method as in claim 22, wherein the membrane sleeve is metal.

26. A method as in claim 22, wherein the membrane sleeve, when expanded, substantially fills the annular space extending between the wellbore and the sand-control device by deforming to substantially contour the wellbore.

* * * * *